US008578948B2

(12) United States Patent
Bickford

(10) Patent No.: US 8,578,948 B2
(45) Date of Patent: Nov. 12, 2013

(54) SHAPE MEMORY POLYMER COSMETIC BRUSH

(75) Inventor: William R. Bickford, Ronkonkoma, NY (US)

(73) Assignee: ELC Management LLC, New York, NY (US)

( * ) Notice: Subject to any disclaimer, the term of this patent is extended or adjusted under 35 U.S.C. 154(b) by 0 days.

(21) Appl. No.: 13/369,607

(22) Filed: Feb. 9, 2012

(65) Prior Publication Data

US 2012/0138080 A1 Jun. 7, 2012

Related U.S. Application Data

(63) Continuation of application No. 12/236,645, filed on Sep. 24, 2008, now Pat. No. 8,136,536.

(51) Int. Cl.
*A45D 40/24* (2006.01)
*A45D 40/26* (2006.01)
*A46D 1/00* (2006.01)

(52) U.S. Cl.
USPC ..... 132/317; 132/320; 15/207.2

(58) Field of Classification Search
USPC ..... 132/218, 216, 217, 320, 120, 148, 317, 132/318, 73; 15/206, 207, 207.2, 167.3, 15/167.1, DIG. 6; 401/9, 10, 129, 122, 401/126, 128, 130; 300/21; 428/371, 377; 57/210
See application file for complete search history.

(56) References Cited

U.S. PATENT DOCUMENTS

| | | | | |
|---|---|---|---|---|
| 3,016,554 | A * | 1/1962 | Peterson | 15/207.2 |
| 3,186,018 | A | 6/1965 | Shaw | |
| 3,698,770 | A * | 10/1972 | Landen et al. | 300/1 |
| 3,875,608 | A * | 4/1975 | Weiss | 15/193 |
| 4,253,213 | A * | 3/1981 | Marino | 15/192 |
| 4,365,642 | A | 12/1982 | Costa | |
| 4,733,425 | A | 3/1988 | Hartel et al. | |
| 4,887,622 | A | 12/1989 | Gueret | |
| 4,971,081 | A | 11/1990 | Seja et al. | |
| 5,161,555 | A | 11/1992 | Cansler et al. | |
| 5,165,760 | A | 11/1992 | Gueret | |
| 5,551,456 | A | 9/1996 | Hartel | |
| 5,567,072 | A | 10/1996 | Dunleavy et al. | |
| 5,595,198 | A | 1/1997 | Kemmerer | |
| 5,657,778 | A | 8/1997 | Gueret | |
| 5,762,432 | A | 6/1998 | Dunleavy et al. | |
| 6,012,465 | A | 1/2000 | Gueret | |
| 6,176,631 | B1 | 1/2001 | Gueret | |
| 6,279,583 | B1 | 8/2001 | Neuner | |
| 6,280,113 | B1 | 8/2001 | Gueret | |
| 6,295,994 | B1 | 10/2001 | Thayer et al. | |
| 6,309,125 | B1 | 10/2001 | Peters | |
| 6,442,785 | B1 | 9/2002 | Robinson | |
| 6,450,177 | B1 | 9/2002 | Christoforu et al. | |
| 6,481,445 | B1 | 11/2002 | Miraglia | |
| 6,720,402 | B2 | 4/2004 | Langer et al. | |
| 6,810,885 | B2 | 11/2004 | Montoli et al. | |
| 6,923,187 | B2 | 8/2005 | Montoli et al. | |
| 7,052,199 | B2 | 5/2006 | Rousselet | |
| 7,091,297 | B2 | 8/2006 | Mather et al. | |
| 7,125,188 | B2 | 10/2006 | Gueret | |
| 7,524,914 | B2 | 4/2009 | Mather et al. | |
| 7,628,116 | B2 | 12/2009 | Browne et al. | |
| 7,654,271 | B2 | 2/2010 | Wyatt et al. | |
| 7,721,379 | B2 | 5/2010 | Takahashi | |
| 2001/0019221 | A1 * | 9/2001 | Waghorn | 300/21 |
| 2004/0168698 | A1 | 9/2004 | Gueret | |
| 2005/0031401 | A1 | 2/2005 | Gueret | |
| 2005/0066990 | A1 | 3/2005 | Rousselet | |
| 2005/0145262 | A1 | 7/2005 | Dunton et al. | |
| 2005/0245719 | A1 | 11/2005 | Mather et al. | |
| 2006/0162737 | A1 | 7/2006 | Montoli | |
| 2006/0242779 | A1 * | 11/2006 | Milheim et al. | 15/195 |
| 2007/0017544 | A1 | 1/2007 | Gueret | |
| 2007/0157945 | A1 | 7/2007 | Lhoyer et al. | |
| 2008/0011317 | A1 | 1/2008 | Malvar et al. | |
| 2008/0104785 | A1 | 5/2008 | Robinson | |

(Continued)

FOREIGN PATENT DOCUMENTS

| | | |
|---|---|---|
| EP | 1444918 | 8/2004 |
| FR | 2825247 | 12/2002 |
| JP | 01-108099 | 4/1989 |
| JP | 02-124030 | 10/1990 |
| JP | 02-142213 | 12/1990 |
| JP | 6-121711 | 5/1994 |
| JP | 2001-061544 | 3/2001 |
| JP | 2002-504585 | 2/2002 |
| WO | WO99/42528 | 8/1999 |

OTHER PUBLICATIONS

PCT International Search Report; International Application No. PCT/US2009/057504; Completion Date: Apr. 29, 2010; Date of Mailing: May 4, 2010.

PCT Written Opinion of the International Searching Authority, or the Declaration; International Application No. PCT/US2009/057504; Completion Date: Apr. 29, 2010; Mailing Date: May 4, 2010.

Supplementary European Search Report; EP Applic. 09816727.3; Completion Date: June 14, 2013; Date of Mailing: Jun. 21, 2013.

*Primary Examiner* — Vanitha Elgart
(74) *Attorney, Agent, or Firm* — Martin W. Haerter

(57) ABSTRACT

A cosmetic brush includes bristles made from shape memory polymer (SMP) filaments or fibers. The shape memory polymer filaments are selected to exhibit a first shape during assembly of the brush, and a second shape after exposure to an external stimulus in the form of heat or other energy. The SMP filaments are initially assembled to the base of the brush. The first shape can be straight to facilitate assembly of the fibers to the base. The second shape, after assembly and after being subjected to the external stimulus, can be any bristle shape suitable for enhancing the function of the brush, e.g., kinked, wavy or coiled. The brush may be comprised solely of SMP filaments, or may be a blend of SMP filaments and any other suitable filament (e.g., nylon, natural plant or animal fibers, etc.).

11 Claims, 6 Drawing Sheets

(56) References Cited

U.S. PATENT DOCUMENTS

| | | | | |
|---|---|---|---|---|
| 2008/0142034 | A1 | 6/2008 | Manici et al. | |
| 2008/0283077 | A1 | 11/2008 | Gueret | |
| 2008/0314510 | A1 | 12/2008 | Hood | |
| 2009/0071499 | A1 | 3/2009 | Wyatt et al. | |
| 2009/0229064 | A1* | 9/2009 | Robinson | 15/191.1 |
| 2009/0276973 | A1 | 11/2009 | Bouix et al. | |
| 2009/0293900 | A1 | 12/2009 | Holloway et al. | |
| 2010/0037911 | A1 | 2/2010 | Kim | |
| 2010/0059080 | A1 | 3/2010 | Gueret | |
| 2010/0089415 | A1 | 4/2010 | Vandromme | |
| 2010/0196705 | A1 | 8/2010 | Hood et al. | |

* cited by examiner

FIG. 5A
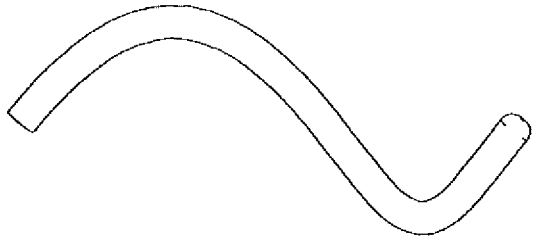
FIG. 5B
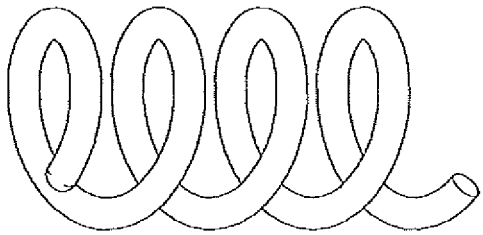
FIG. 5C
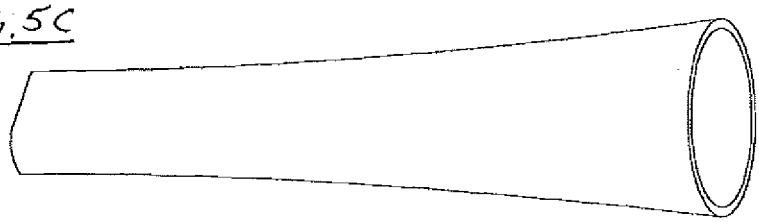
FIG. 5D
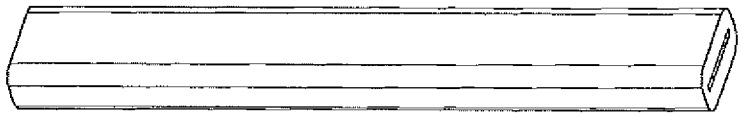
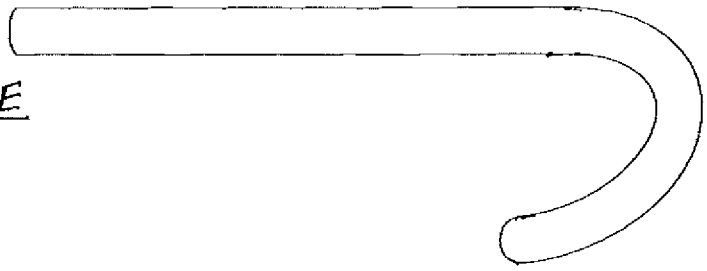
FIG 5E

SHAPE MEMORY POLYMER COSMETIC BRUSH

CROSS-REFERENCE TO RELATED APPLICATIONS

This application is a continuation of U.S. Non-Provisional patent application Ser. No. 12/236,645 filed Sep. 24, 2008 now U.S. Pat. No. 8,136,536.

BACKGROUND OF THE INVENTION

1. Field of the Invention

The present invention relates to cosmetic brushes. More particularly, it relates to cosmetic brushes with bristles extending radially from a twisted wire core. In particular, it relates to mascara brushes made with shape memory polymer bristles.

2. Description of the Prior Art

Cosmetic brushes having a twisted wire core are known, such as, for example, mascara brushes used to apply mascara to a user's eyelashes. A typical mascara brush is comprised of a core formed from a metallic wire folded in a generally u-shaped configuration to provide a pair of parallel segments or lengths of wire. Bristles (also referred to as filaments or fibers), usually comprised of discrete strands of nylon or other synthetic material, are disposed between a portion of the lengths of the wire segments. The wire segments are then twisted, or rotated, about each other to form a helical core (also known as a twisted wire core) which grips the filaments medially of their outer ends, usually substantially at their midpoints, so as to clamp them. In this way, a bristle portion or bristle head is formed with radially extending bristles secured in the twisted wire core in a helical or spiral manner. See, for example, U.S. Pat. No. 4,887,622 to Gueret, and U.S. Pat. No. 4,733,425 to Hartel et al. Each patent cited herein is incorporated by reference in its entirety.

To apply mascara to a user's eyelashes, a brush must be capable of picking up and transporting a supply of mascara from a reservoir and depositing it on a user's eyelashes. Generally, a mascara applicator is inserted into a container having a reservoir of mascara or some other cosmetic product. The bristles are arranged so as to pick up a supply of mascara or product and carry it from the container for application to a user's eyelashes. See, for example, U.S. Pat. No. 4,365,642 to Costa, U.S. Pat. No. 4,733,425 to Hartel et al., and U.S. Pat. No. 4,887,622 to Gueret.

Mascara applicators are preferred that optimize, for example, a combination of loading, application and combing characteristics. Loading refers to the capacity of the applicator to carry product such as mascara. Brushes that maximize loading minimize the number of times a user must introduce the applicator into the reservoir to replenish the supply of mascara product carried on the brush. Application refers to the ability of the brush to deposit product, e.g., mascara, onto a selected site, e.g., eyelashes. Application characteristics are optimized in an applicator that, for example, deposits sufficient quantities of mascara to eyelashes in a uniform and attractive manner and in as few strokes as possible. Combing refers to the ability of a brush to remove clumps by doctoring mascara already applied to lashes and separating lashes that are stuck together. Combing characteristics are optimized in an applicator that properly separates the lashes and distributes or removes excess mascara to provide a finished appearance.

A brush that maximizes loading may have application and combing characteristics that are less satisfactory. For example, a heavily loaded brush may apply excess cosmetic to the eyelashes, thus requiring extra application or combing strokes to remove the excess. Conversely an applicator that applies product or combs lashes with minimal strokes to achieve a finished appearance may carry an insufficient load of product. Accordingly, an ideal applicator optimizes a combination of loading, application and combing characteristics, so that a finished appearance may be expeditiously accomplished in as few strokes as possible and with as few introductions of the applicator into the mascara reservoir as possible.

It is known that providing a bristle head with bristles or fibers of different lengths can improve the loading, application and combing characteristics of a mascara brush. The shorter bristles are believed to improve loading and application characteristics of the brush, while the longer bristles are believed to improve combing characteristics of the brush. For example, a bristle portion of a brush can be trimmed, peripherally, diametrically or linearly, or in any combination of these trim modes. Brushes having bristles trimmed to different lengths are disclosed for example in U.S. Pat. No. 5,595,198 to Kemmerer and U.S. Pat. No. 5,551,456 to Hartel. The brushes disclosed in these references have portions formed from long bristles and portions formed from short bristles. U.S. Pat. No. 5,165,760 to Gueret discloses a method for making a brush comprising shorter stiff bristles and longer soft bristles. The brush is initially made from stiff bristles and soft bristles of the same length. During a grinding operation, the stiff bristles are said to be reduced in length to become the shorter bristles, while the soft bristles are said to deflect sufficiently to avoid the grinder, and remain long. A problem with this method is that pre-determining the length of the long and short bristles with respect to each other relies on the difference in stiffness between the stiff and soft bristles. Accordingly, bristles with a difference in degree of stiffness selected to yield a desired bristle length differential may not exhibit ideal brush characteristics, e.g., combing, loading, application, etc. Conversely, bristles that exhibit ideal brush characteristics may not have a sufficient difference in degree of stiffness to yield an optimal bristle length differential. Furthermore, with the disclosed method, it is not possible to make a brush with short soft bristles interspersed with long stiff bristles, and it is not possible to make a brush with long bristles interspersed with short bristles wherein all of the bristles have a uniform stiffness. These latter two bristle arrangements should yield a more desirable applicator since longer, stiff bristles are believed to provide better combing characteristics, and shorter, soft bristles are thought to provide better application characteristics.

U.S. Pat. No. 6,279,583 discloses a brush that has a twisted wire core supporting a plurality of regularly disposed radially extending short and long bristles. The tips of the long bristles define an outer envelope of the brush. The short and long bristles are interspersed such that tips of the short bristles form a layer spaced inwardly from the outer envelope. The brush can be made without regard to bristle stiffness by first forming a brush blank, initially twisting the wire core only sufficiently to secure the bristles for subsequent steps. The blank is then trimmed to define the length of the short and long bristles, the short bristles defined by cutting a series of circumferentially spaced longitudinal grooves in the bristle envelope of the brush blank. The wire segments are then further twisted to displace and disperse the short bristles among the long bristles such that the tips of the short bristles define a layer spaced inwardly from the tips of the long bristles. A disadvantage of making a brush according to this method is that it requires an additional twisting step after the brush is trimmed to define bristle lengths.

Mascara brushes made with various fiber cross-sections (e.g., tubular, U, I or Z shaped, etc.) are known. Also known are mascara brushes made with curved, kinked or wavy fibers. The various cross-sections and the curved, kinked or wavy fibers are believed to provide advantages over bristles made from round cross-section, straight fibers, such as, for example, improved loading and application characteristics. For example, U.S. Pat. No. 5,161,555 to Cansler discloses a mascara brush utilizing heavily waved bristles instead of straight bristles. However, fibers with unusual cross-sections, and/or curved, kinked, flattened or wavy fibers present special difficulties in production. For example, curved, kinked or wavy fibers are subject to tangling, making it difficult to control during the manufacture of twisted wire core brushes the quantity and orientation of fibers placed between the wire segments prior to twisting. This can lead to significant increases in waste in the form of rejected brush heads due to out-of-specification bristle density and/or bristle orientation.

Accordingly, there is a need for improved mascara brushes and methods of making such brushes that do not suffer the limitations of the prior art brushes and methods.

BRIEF SUMMARY OF THE INVENTION

It is an object of the invention to provide a mascara brush and a method of making the brush that overcomes the problems of the prior art.

It is another object of the invention to provide a mascara brush that has bristles of various configurations that is made in a method that minimizes waste and process steps.

It is another object of the invention to provide a mascara brush with bristles having unusual cross-sections, or made from curved, kinked or wavy fibers, without the processing difficulties normally associated with such fibers.

Accordingly, a mascara brush is provided that includes bristles made from shape memory polymer (SMP) filaments or fibers. The SMP filaments are selected to exhibit a first pre-determined configuration (also referred to as the initial configuration) during assembly of the brush, and a second, or final, pre-determined configuration after exposure to an external stimulus. A brush head is initially assembled, i.e., lengths of SMP filaments exhibiting the first pre-determined configuration are placed between wire segments and the wire segments are then twisted about each other to form the helical or twisted wire core. The core grips the SMP filament lengths medially of their outer ends, usually substantially at their midpoints, so as to clamp them. After the brush head is initially assembled, i.e., after the SMP filaments are gripped in the twisted wire segments, the assembled brush head is subjected to an external stimulus. The external stimulus causes all, or at least some, of the SMP filaments to be re-configured into a pre-determined second or final configuration. The external stimulus can take the form of, for example, light, temperature (cold or heat), magnetic, electrical, radio-frequency, microwave, plasma, ionic or particle based energy, or chemical treatment. The brush head may be comprised solely of SMP filaments, or may be a blend of SMP filaments and any other suitable filament (e.g., nylon, natural plant or animal fibers, etc.).

The term "configuration" when used with respect to the filaments may refer to the general, external configuration or shape (the "overall configuration") of the filaments as well as the cross-sectional configuration or cross-sectional shape of the filaments. The overall configuration of the SMP filaments, either initial or final, may, for example, be straight, curved, kinked, wavy, coiled (helical), notched, ridged, channeled, flattened or flanged. The cross-sectional configuration of the SMP filaments, either initial or final, may, for example, be solid, hollow (e.g., tubular or with one or more lumens or passages), round, square, rectangular, S, U, X or T shaped, flanged, flattened, symmetrical or asymmetrical. The cross-sectional configuration may, for example, change from an initial configuration that appears solid to a final configuration that is hollow or channeled. For either the first or initial configuration or the second or final configuration, any combination of overall and/or cross-sectional configuration may be selected, providing a large variety of initial and final bristle outcomes or effects.

For ease of handling and to achieve a more uniform bristle quantity and orientation during assembly, the preferred initial configuration is a filament that is straight, with what appears to be a solid cross-section. After securing the filaments in the core, and applying a suitable external stimulus to activate the shape memory properties of the material, the filaments take on a final configuration, which may include, for example, a coiled (pigtail) overall configuration and with a hollow cross-section. This yields a brush with coiled bristles in a uniform bristle distribution that was previously considerably more difficult to achieve.

For a more random final bristle configuration with respect to bristle distribution and/or density, an opposite approach may be taken. For example, the initial filament configuration is selected to be, for example, kinked, wavy, coiled (helical) or notched. Due to tangling and other physical interactions of the kinked, wavy, coiled or notched filaments, the filaments are more likely to fall in a less even distribution and in a more random orientation relative to the wire segments as they are placed between the segments prior to twisting. After securing the filaments in the twisted wire core and applying a suitable external stimulus to activate the shape memory properties of the filaments, the filaments take on a final configuration, which may include, for example, a straight overall configuration. This yields a brush with straight bristles in a more random distribution and orientation that was previously more difficult to achieve.

It will be understood that any initial configuration may be selected as long as it suitably achieves the desired final configuration after applying the appropriate external stimulus.

BRIEF DESCRIPTION OF THE DRAWINGS

FIGS. 5A-5E are perspective views of bristle configurations that can be selected for either the initial or final configuration;

DETAILED DESCRIPTION OF THE INVENTION

Figure 1A:
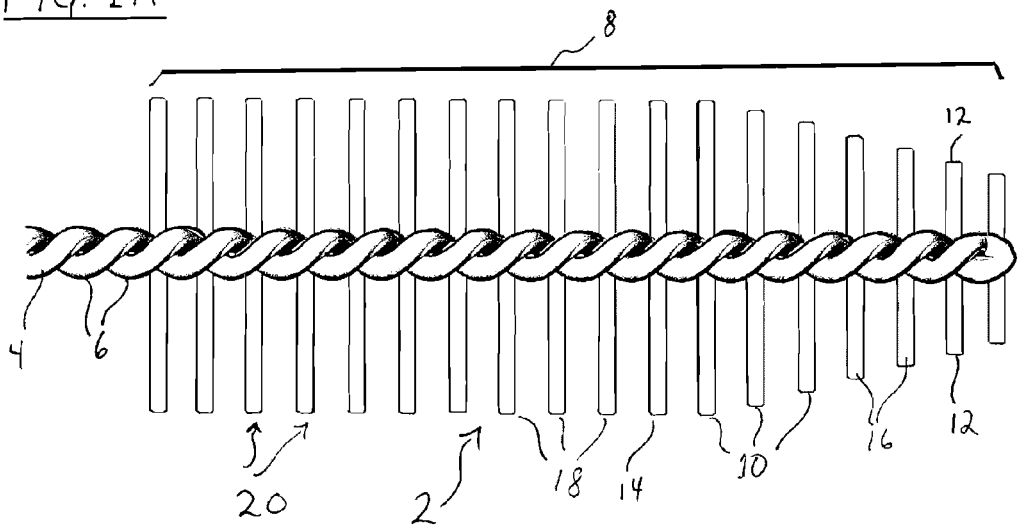
FIG. 1A is an elevation view of a mascara brush according to the invention with the SMP filaments illustrated in schematic form in the initial configuration.
Figure 1B:
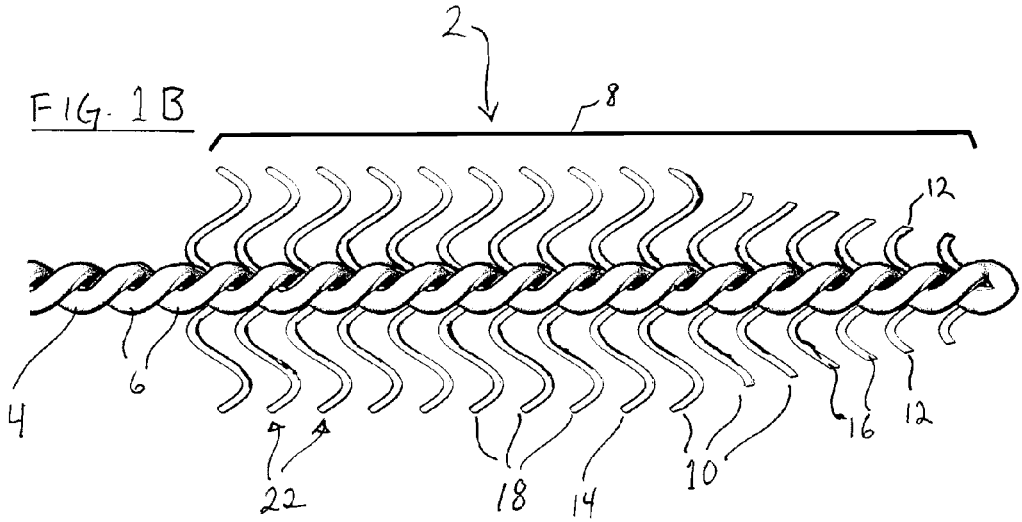
FIG. 1B is an elevation view of the mascara brush of FIG. 1A with the SMP filaments illustrated in schematic form in the final configuration.
Figure 2A:
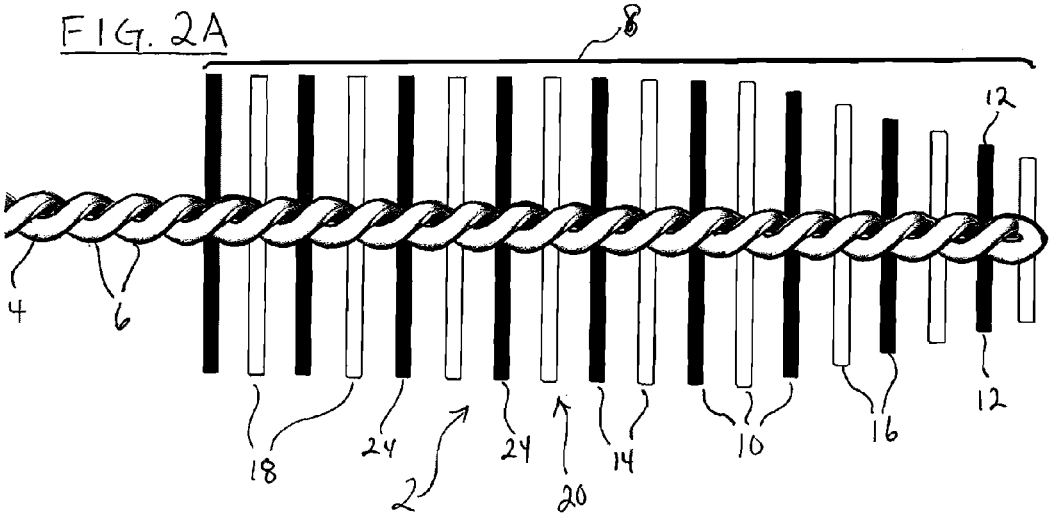
FIG. 2A is an elevation view of a second embodiment of the mascara brush according to the invention made with SMP and non-SMP filaments, and the SMP filaments are illustrated in schematic form in the initial configuration.
Figure 2B:
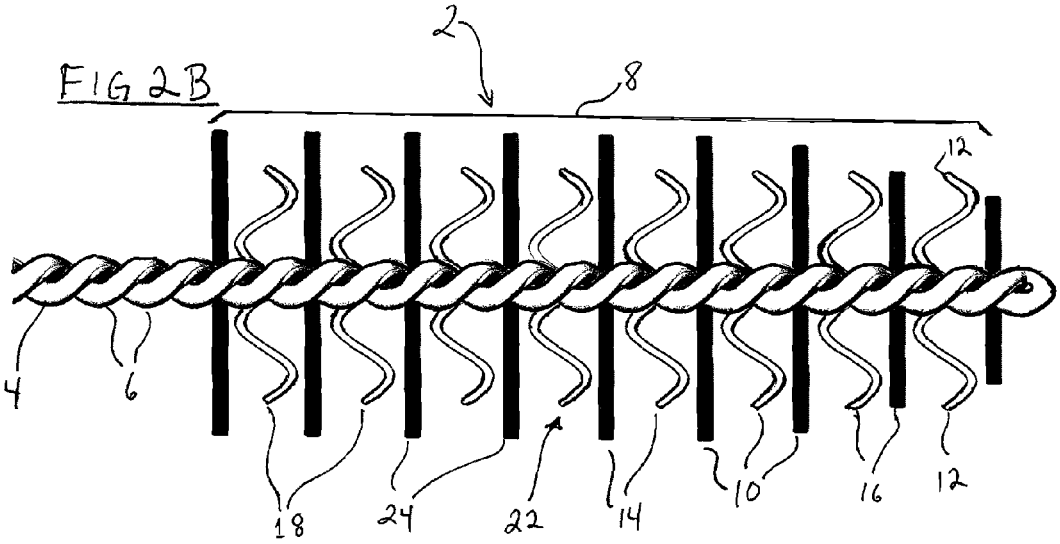
FIG. 2B is an elevation view of the embodiment of the mascara brush of FIG. 2A with the SMP filaments illustrated in schematic form in the final configuration.
Figure 3A:
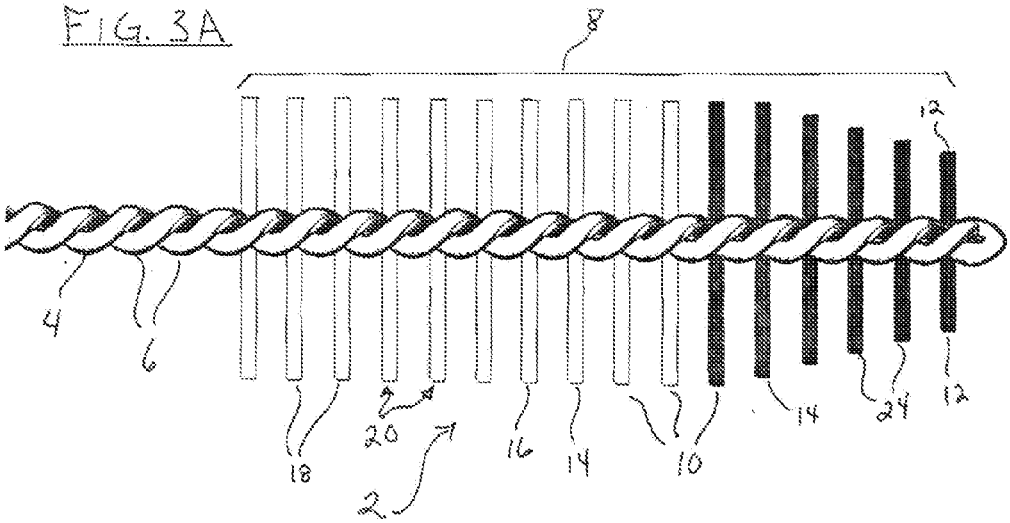
FIG. 3A is an elevation view of a third embodiment of the mascara brush according to the invention made with SMP and non-SMP filaments, and the SMP filaments are illustrated in schematic form in the initial configuration.
Figure 3B:
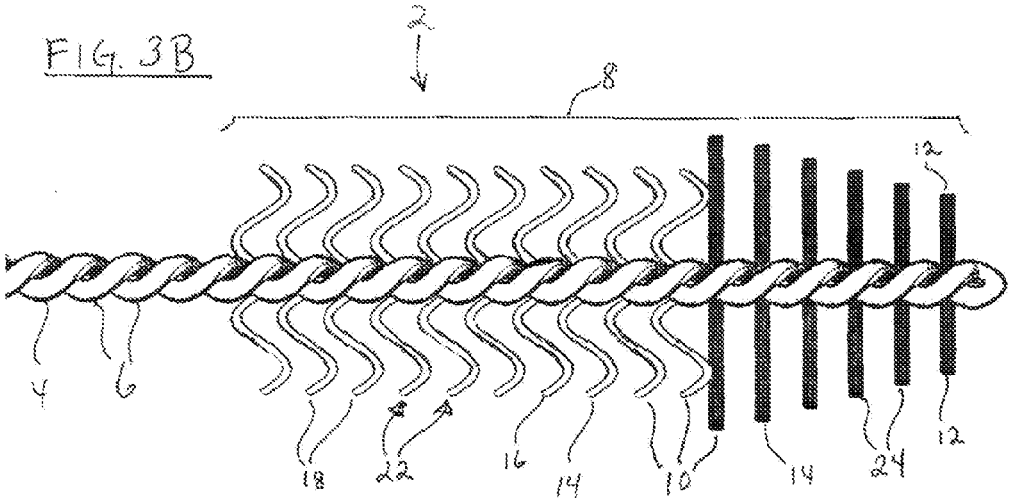
FIG. 3B is an elevation view of the embodiment of the mascara brush of FIG. 3A with the SMP filaments illustrated in schematic form in the final configuration.
Figure 4:
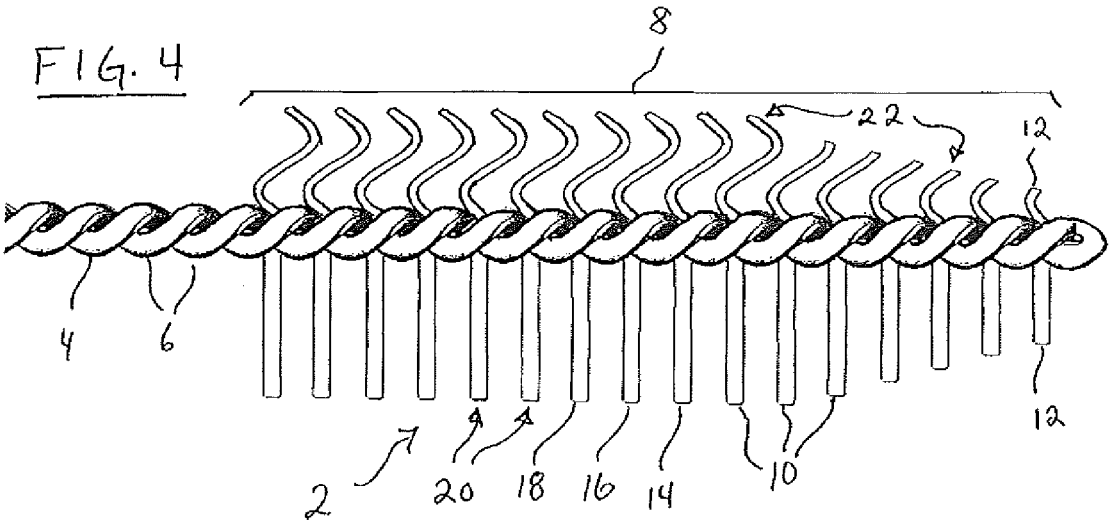
FIG. 4 is an elevation view of a fourth embodiment of the mascara brush according to the invention made with SMP filaments, wherein some of the SMP filaments are illustrated in schematic form in the initial configuration and some of the SMP filaments illustrated in schematic form in the final configuration.

Referring now to FIGS. 1-5, a mascara applicator brush is shown generally at 2. The brush has a core 4 formed by lengths 6 of metallic wire helically twisted together. A bristle portion 8 of the brush 2 has a plurality of bristles 10 extending radially from the core 4. Pairs 12 of the bristles 10 are formed by discrete filaments 14 which are gripped medially of their outer ends 16 by the twisted lengths 6 of wire. At least some of the filaments 14 are shape memory polymer filaments 18 adapted to have a first or initial configuration 20 (FIGS. 1A, 2A, 3A and 4) during assembly of the bristle portion 8, and a second or final configuration 22 (FIGS. 1B, 2B, 3B and 4) in response to an external stimulus applied subsequent to assembly of the bristle portion 8. As illustrated in FIGS. 2 and 3, the brush may also have bristles made from conventional, non-shape memory filaments 24. Throughout the accompanying drawings, the shape memory polymer filaments 18 are illustrated schematically in an outline form, and conventional (non-shape memory) filaments 24 are illustrated in a solid black form.

Shape memory polymers are materials that have the capability of changing their shape between distinctive shapes, i.e., from an original shape (the 'out-of-the-extruder' shape) to a first or initial shape that is 'programmed' (a temporary shape), and then from that initial, programmed shape to a final shape substantially the same as the original shape. In other words, an item made with SMP 'remembers' its original shape and returns to it when appropriately stimulated. The initial shape is determined by applying a process called programming. During the programming process, the original shape, for example, a wavy shape filament, is manipulated into an initial shape, e.g., a straight shape, by, for example, mechanical stretching or pressing which may be accompanied by heat, cold or other energy to temporarily 'fix' the initial shape. To return the SMP fiber from the initial shape (e.g., straight) to its final shape (e.g., wavy), the SMP fiber is subjected to an external stimulus such as a change in temperature or exposure to energy waves. The SMP filament then changes in a controlled fashion from the initial shape (the first or programmed shape) back to an original shape (the second or "final" shape). Thus, when exposed to an appropriate stimulus, SMP's can change shape in a predefined way from the initial shape to the final shape. This process applies to any SMP, including those designed to be biodegradable.

For the change from the initial shape to the final shape, the external stimulus can take the form of, for example, light, temperature (cold or heat), magnetic, electrical, radio-frequency, microwave, plasma, ionic or particle based energy, pH value, humidity level (RH) or chemical treatment. The catalyst (temperature for example) for the change from one shape to another, e.g., from the original shape to the initial shape, or, more particularly, from the initial shape to the final shape, is predetermined and pre-programmed into the polymer. Temperatures that trigger the reaction for example, could be set within the ideal range of 0° C. to 250° C., with an overall range of −40° C. to 400° C. Humidity levels between 0% and 100% could trigger the change. Simple immersion in water or liquid could trigger the change. Exposure to plasma treatment, corona treatment, or a change in surface dyne levels could trigger the change. Microwaves between 1 GHz and 300 GHz could trigger the change. Light waves between 1 nm (Extreme UV range), 400-700 nm (visible light) up to 1 mm (IR-C Infrared) nanometers could trigger the change. A pre determined pH level between 1 and 14 could trigger the change. Applied electricity could be by voltage (50 micro volts to 80,000 volts), by current (5 micro amperes to 30,000 amperes) or by resistance (1 micro-ohm to 2000 ohms). A broader radiation range could be from radio waves ($10^3$) meters to gamma rays ($10^{-12}$) meters. For the change from the original shape to the initial shape, the external stimulus can include any of the foregoing stimuli and may also take the form of mechanical working, such as, for example, pressing, stretching, bending, etc., to program the SMP material. The external stimulus can be provided in the form of a hot gas or liquid applied to the SMP filaments. For example, subsequent to formation of the bristle portion, the brush heads may be subjected to a flow of hot or cold air, or may be dipped in a hot or cold liquid bath. Alternatively, the stimulus may be in the form of radiant or light energy, or UV, radio, micro or other energy waves directed at the SMP fibers.

SMP filaments suitable for use in mascara brushes include CRG Veriflex polymer filaments available from CRG Industries (Cornerstone Research Group), Dayton, Ohio. Any combination of initial and final filament shape or configuration suitable for the needs of the brush manufacturer and ultimately the brush consumer can be selected. Some examples of filament shapes/configurations are provided in FIGS. 5A-5E, 6A-6B and 7A-7B. FIG. 5A illustrates a wavy configuration filament. FIG. 5B illustrates a coiled, helix or 'pigtail' shaped filament. FIG. 5C illustrates a hollow, horn-like configuration filament. FIG. 5D illustrates a flattened bar-like configuration. And FIG. 5E illustrates a J-shaped filament—a hooked configuration.

Figure 6A:
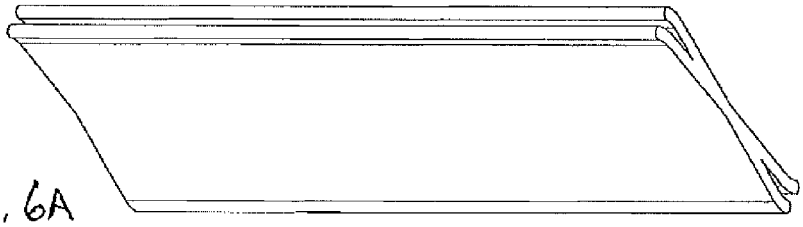
FIGS. 6A-6B are perspective views other bristle configurations that can be selected for either the initial or final configuration.
Figure 6B:
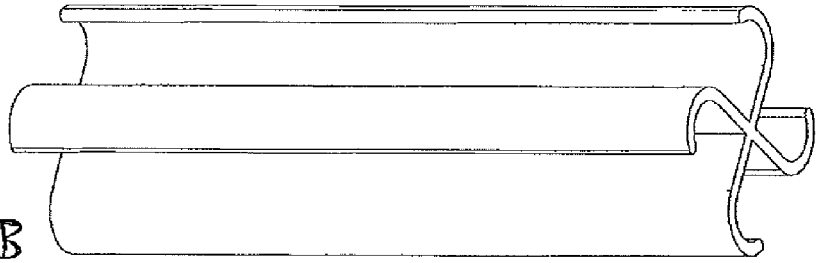

FIG. 6A illustrates a section of filament with a relatively flattened X-shaped cross-sectional profile. FIG. 6B illustrates the same filament section with the X-shaped cross-sectional profile expanded. In the expanded state, the free ends of the X-shaped profile are hooked. The filament can be programmed such that either the flattened or expanded cross-sectional profile may be the initial profile, and the other cross-sectional profile will be the final profile.

Figure 7A:
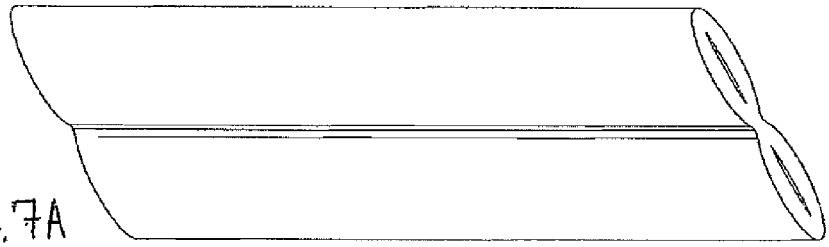
FIGS. 7A-7B are perspective views other of bristle configurations that can be selected for either the initial or final configuration.
Figure 7B:
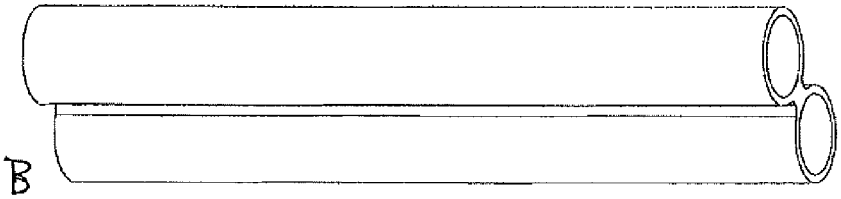

FIG. 7A illustrates a section of filament with a relatively flattened double lumen, figure-8 shaped cross-sectional profile. FIG. 7B illustrates the same filament section with the double lumen, figure-8 shaped cross-sectional profile expanded. The filament can be programmed such that either the flattened or expanded cross-sectional profile may be the initial profile, and the other cross-sectional profile will be the final profile.

The cross-sectional configuration of the SMP filaments, either initial or final, may, for example, be solid, hollow (e.g., tubular or with one or more lumens or passages), round, square, rectangular, S, U, X or T shaped, flanged, flattened, symmetrical or asymmetrical (see, for example, the bristle cross-sections disclosed in U.S. Pat. Nos. 7,125,188, 7,052,199, 6,481,445, 6,450,177, 6,176,631, 6,012,465, 5,762,432, 5,657,778, 5,567,072 and 3,186,018, each incorporated in its entirety by reference herein). It will be understood that these overall and cross-sectional filament shapes and/or configurations are merely illustrative and any suitable shape or configuration filament can be used to achieve the ends of the brush manufacturer, and ultimately the brush user. Typically, mascara brushes have bristles that are solid or hollow, in a thickness of from 1 mil to about 12 or 14 mil.

For example, to make the brush illustrated in FIG. 1B, i.e., a brush with all bristles made from SMP filaments, and all bristles exhibiting the final SMP filament form, one would obtain a quantity of SMP filaments in the initial form (FIG. 1), i.e., programmed to be straight. The initial configuration filaments would then be placed between the wire segments 6 and the wire segments would be twisted about each other to form the twisted wire core 4. Note that in the illustrations, the wire segments 6 are actually a single wire folded into a hairpin or u-shape to form two adjacent wire segments. However, the segments 6 could also be formed from two separate wire pieces placed adjacent to each other. The core 4 grips the SMP filament lengths 18 medially of the outer ends 16, usually substantially at their midpoints, so as to clamp them. After the bristle portion 8 is initially assembled, i.e., after the SMP filaments 18 are gripped in the twisted wire core 4, the assembled brush head is subjected to an external stimulus, such as hot air or a hot liquid bath. The external stimulus causes all (FIG. 1A), or at least some (FIG. 4), of the SMP filaments to be re-configured to a pre-determined second or final configuration, i.e., the wavy configuration shown in FIGS. 1A and 4. Because the initial configuration for the filaments of this example are straight, bristle distribution and density is relatively easy to manage and control during the assembly of the bristle portion. Accordingly, the resulting final brush has wavy bristles in a uniform distribution and density, a result that was previously significantly more difficult to achieve.

If on the other hand, the objective is to achieve a brush with straight bristles but a more random bristle distribution and density, the process could be reversed, i.e., the initial configuration of SMP bristles could be wavy (FIG. 1B). The tangling of the wavy bristles during assembly into the core would yield a more random bristle distribution and density along the core. The final configuration of the SMP bristles after application of the external stimuli would be straight bristles in a random distribution along the core and with a random density (not illustrated).

The brush head may be comprised solely of SMP filaments (FIGS. 1 and 4), or may be a blend (FIG. 2) or clustering (FIG. 3) of SMP filaments and conventional filaments. Conventional filaments for the purposes of this application are any filaments that are not SMP filaments and that are suitable filaments for use in a cosmetic applicator, particularly a mascara applicator. Conventional filaments include, for example, nylon, elastomer, natural plant or animal fibers, biodegradable fibers, etc., that are well known in the art. While the SMP filaments react to the external stimulus and change shape (compare FIGS. 2A, 3A with FIGS. 2B, 3B, respectively), the conventional filaments substantially retain their original shape throughout the process (except to the extent due to pinching of the conventional filaments where they are gripped in the twisted wire core).

Filaments gripped in the core may be trimmed before or after the SMP final configuration is achieved. For example, the bristles could be trimmed to a final shape as illustrated in the FIGS. 1-4 prior to applying the external stimulus. In the case of the mixed fiber embodiment shown in FIG. 2B, this would yield a brush with longer conventional bristles and shorter SMP bristles because the conversion from the straight configuration to the wavy configuration would likely result in a slight reduction in the apparent length of the SMP bristles. If a brush is desired with all bristles, conventional and SMP, having the same length, the bristles can be trimmed subsequent to application of the external stimuli.

Although the illustrations show the SMP fibers being reduced in length due to application of the external stimulus, it will be understood that SMP filaments can be programmed to achieve an opposite result. In other words, SMP filaments can be programmed to an initial configuration that is relatively shortened, and subsequent to application of an appropriate external stimulus, return to an original configuration that is relatively longer than the initial configuration.

While the discussion above is directed to mascara brush, the invention also includes other types of cosmetic brushes, such as, for example, cheek or blush brushes, eye shadow brushes, foundation brushes, eye brow brushes, etc. For example, a cosmetic brush comprising a base with a bristle portion extending from the base can include bristles at least some of which are shape memory polymer filaments. The SMP filaments are adapted to have a first configuration during assembly of the bristle portion to the base of the brush, and a second pre-determined configuration that manifests in response to an external stimulus applied subsequent to assembly of the bristle portion. The bristles can be secured to the base in any conventional manner such as, for example, stapling in a bore (similar to a tooth brush) or clamping in a metal ferrule (similar to a paintbrush).

It is understood that various modifications and changes in the specific form and construction of the various parts can be made without departing from the scope of the following claims.

What is claimed is:

1. A cosmetic brush for applying blush, eye shadow or foundation to a user; the brush comprising:

a base; and a bristle portion extending from the base, the bristle portion comprising a plurality of non-metallic bristles for applying blush, eye shadow, or foundation to a user secured to the base, at least some of the plurality of bristles are shape memory polymer filaments adapted to have a first programmed configuration during assembly of the bristle portion to the base of the brush, and a second pre-determined configuration in response to an external stimulus applied subsequent to assembly of the bristle portion.

2. The cosmetic brush of claim 1 wherein the external stimulus is a change in temperature.

3. The cosmetic brush of claim 2 wherein the change in temperature comprises one of heat or cold applied to the shape memory polymer filaments.

4. The cosmetic brush of claim 2 wherein the change in temperature is applied to the shape memory polymer filaments by immersing at least part of the bristle portion in a hot or cold liquid bath.

5. The cosmetic brush of claim 2 wherein the change in temperature is applied to the shape memory polymer filaments by subjecting at least part of the bristle portion to a stream of hot or cold gas.

6. The cosmetic brush of claim 1 wherein the external stimulus is energy selected from one of electricity, magnetism, light, radio frequency, micro-wave or radiation.

7. The cosmetic brush of claim 1 wherein the first configuration is selected from one of straight, curved, kinked, wavy, coiled, notched, ridged, channeled and flanged.

8. The cosmetic brush of claim 1 wherein the first programmed configuration is straight and the second pre-determined configuration is selected from one of curved, kinked, wavy, coiled, notched, ridged, channeled and flanged.

9. The cosmetic brush of claim 1 wherein the first programmed configuration is selected from one of curved, kinked, wavy, coiled, notched, ridged, channeled and flanged and the second pre-determined configuration is straight.

10. The cosmetic brush of claim 1 wherein the first programmed configuration cross-section is selected from one of solid, hollow, round, square, rectangular, S, U, X or T shaped, flanged, flattened, symmetrical and asymmetrical.

11. The cosmetic brush of claim 1 wherein the second pre-determined configuration cross-section is selected from one of solid, hollow, round, square, rectangular, S, U, X or T shaped, flanged, flattened, symmetrical and asymmetrical.

* * * * *